United States Patent [19]

Moon

[11] Patent Number: 4,968,870

[45] Date of Patent: Nov. 6, 1990

[54] HAIR CURLING APPLIANCE POWER CONTROL CIRCUIT

[75] Inventor: Chui C. Moon, North Point, Hong Kong

[73] Assignee: Well Treasure Industries, Ltd., Kwun Tong, Hong Kong

[21] Appl. No.: 266,847

[22] Filed: Nov. 3, 1988

[51] Int. Cl.[5] ..... H05B 1/02; A45D 1/04

[52] U.S. Cl. ..... 219/222; 219/489; 219/492

[58] Field of Search ..... 219/492, 501, 250, 240, 219/222, 223, 224, 225, 486, 489; 132/232

[56] References Cited

U.S. PATENT DOCUMENTS

| | | | |
|---|---|---|---|
| 3,385,957 | 5/1968 | Munson et al. | 219/501 |
| 3,827,345 | 9/1974 | Willson | 219/489 |
| 4,085,309 | 4/1978 | Godel et al. | 219/501 |
| 4,223,498 | 11/1980 | Payne et al. | 219/486 |
| 4,348,583 | 9/1982 | Bube et al. | 219/492 |
| 4,375,205 | 3/1983 | Green | 219/492 |
| 4,642,441 | 2/1987 | Kenyon | 219/501 |
| 4,673,798 | 6/1987 | Contri et al. | 219/240 |

FOREIGN PATENT DOCUMENTS

| | | | |
|---|---|---|---|
| 184617 | 10/1983 | Japan | 219/492 |
| 192117 | 11/1983 | Japan | 219/492 |

*Primary Examiner*—A. D. Pellinen
*Assistant Examiner*—Geoffrey S. Evans
*Attorney, Agent, or Firm*—Burns, Doane, Swecker & Mathis

[57] ABSTRACT

A power control circuit for supplying electrical power from a power source to an electrical appliance having a heating element, which circuit comprises an input for connection to a power source, an output for connection to a heating element, and supply elements between the input and the output for supplying power at a first, relatively higher level for a predetermined start-up time interval, and at a second, relatively lower level after the predetermined start-up time interval has elapsed.

After the start-up time interval, first timing elements brings into operation second timing elements which switches a silicon controlled rectifier off or on, via a NAND gate and transistor to supply power intermittently to the heating element.

10 Claims, 1 Drawing Sheet

HAIR CURLING APPLIANCE POWER CONTROL CIRCUIT

FIELD OF THE INVENTION

The present invention relates to a power control circuit for supplying electrical power from a power source to an electrical appliance having a heating element.

SUMMARY OF THE INVENTION

According to the invention there is provided a power control circuit for supplying electrical power from a power source to an electrical appliance having a heating element, the circuit comprising an input for connection to a said power source, an output for connection to a said heating element, and supply means between the input and the output for supplying power at a first, relatively higher level for a predetermined start-up time interval, and at a second, relatively lower level after the predetermined start-up time interval has elapsed.

Preferably, power is supplied continuously to the heating element during the start-up time internal and is supplied intermittently thereafter so as to provide a timeaveraged lower level of power.

More preferably, said supply means comprises first timing means for determining the start-up time interval, and second timing means for providing a signal to control the supply of power to a said heating element.

Preferably, the second timing means is in use inhibited from providing the signal by the first timing means during the start-up time interval.

The invention also provides an electrical hair curler incorporating such a power control circuit.

Other preferred features and advantages of the invention will be apparent from the following description and the accompanying claims.

BRIEF DESCRIPTION OF THE DRAWINGS

The invention will now be more particularly described, by way of example only, with reference to the accompanying drawings, in which.

DETAILED DESCRIPTION OF THE INVENTION

Figures 1, 2:
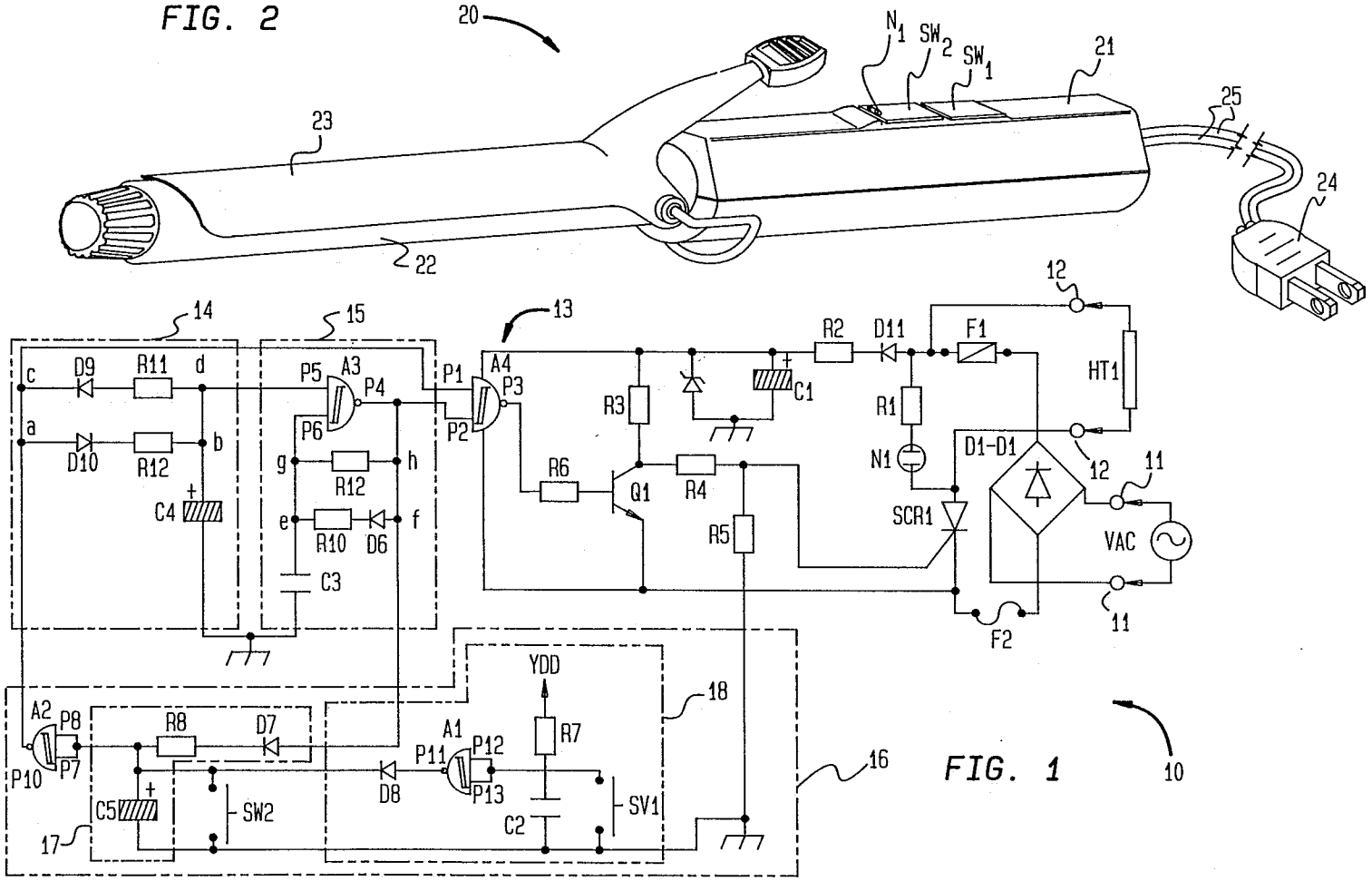
FIG. 1 is a schematic circuit diagram of an embodiment of a power control circuit in accordance with the invention.
FIG. 2 is a perspective view of an electrical hair curler incorporating the power control circuit of FIG. 1.

In the drawings, FIG. 1 shows an embodiment of a power control circuit 10 in accordance with the invention, for supplying electrical power from a power source $V_{ac}$ to a heating element $HT_1$ of an electrical hair curler 20 (FIG. 2) which is also in accordance with the invention. The power control circuit 10 comprises an input 11 for connection to the power supply $V_{ac}$, an output 12 for connection to the heating element $HT_1$, and supply means 13.

The heating element $HT_1$ is connected in series with a silicon controlled rectifier $SCR_1$ across the output of a bridge rectifier $D_1$-$D_4$ whose input 11 is connected to the power supply $V_{ac}$.

$SCR_1$ is switched on and off to control the supply of power to the heating element $HT_1$. Switching of $SCR_1$ is controlled by a NAND gate $A_4$ and transistor $Q_1$. The inputs $P_1$ and $P_2$ to NAND gate $A_4$ are controlled respectively by a turn-on/turn-off circuit 16 and timing circuits 14 and 15. Circuit 16 serves to control the initial turn on of the power control circuit 10 which is operated manually by a user at switch $SW_2$ and also turned off at switch $SW_1$. A master timer 17 in circuit 16 switches off the supply of power to heating element $HT_1$ automatically after a predetermined time interval set by capacitor $C_5$ and resistor $R_8$, e.g. after from 30 to 90 minutes, which can be factory set.

On initial turn on at switch $SW_2$, the first and second timing circuits 14, 15 are, in effect, bypassed and the output from gate $A_4$ is set low to turn off the transistor $Q_1$ and hence turn on $SCR_1$ to supply power continuously to heating element $HT_1$. Timing circuit 15 comes into effect after a start-up period determined by timing circuit 14. When timing circuit 15 is brought into effect, it controls gate $A_4$, switching its output alternately high and low, thus turning transistor $Q_1$ and hence $SCR_1$ off and on. Hence the time-averaged power fed to heating element $HT_1$ is reduced according to the on-off time of $SCR_1$.

The power control circuit 10 and its operation will now be described in more detail.

First timing means 14 includes a capacitor $C_4$, a charging path a-b formed by a diode $D_{10}$ and a resistor $R_{12}$ for the capacitor $C_4$, and a discharging path c-d formed by a diode $D_9$ and a resistor $R_{11}$ for the capacitor $C_4$. The second timing means 15 is an oscillator which includes a logic NAND gate $A_3$, a capacitor $C_3$, a charging path e-f formed by a diode $D_6$ and a resistor $R_{10}$ for the capacitor $C_3$, and a path g-h formed by a resistor $R_9$ through which the capacitor $C_3$ can be charged or discharged.

The NAND gate $A_3$ has an output $P_4$ and two inputs $P_5$ and $P_6$ to which the capacitors $C_4$ and $C_3$ respectively are connected. The two paths e-f and g-h are both connected across the input $P_6$ and the output $P_4$ of the NAND gate $A_3$ so that the second timing means will oscillate, i.e. the capacitor $C_3$ charging and discharging alternately, when the input $P_5$ is at logic high.

The output signal of the second timing means 15 is taken at the output $P_4$ of the NAND gate $A_3$, and is in turn fed to an input $P_2$ of a logic NAND gate $A_4$. An output $P_3$ of the NAND gate $A_4$ serves to provide a firing signal which is fed to an inverter formed by a NPN transistor $Q_1$ and resistors $R_3$, $R_4$, $R_5$ and $R_6$, connected in the usual manner. The inverted firing signal is taken at circuit node i between the two resistors $R_4$ and $R_5$, and is fed to the gate terminal of a silicon-controlled rectifier $SCR_1$.

The $SCR_1$ and the heating element $HT_1$ are connected in series across the anode and cathode of a bridge rectifier $D_1$-$D_4$. The two a.c. inputs of the bridge rectifier $D_1$-$D_4$ serve as the input 11 of the power control circuit 10, and the bridge rectifier $D_1$-$D_4$ converts an a.c. voltage received from the power source $V_{ac}$ into a pulsating d.c. voltage, which is in turn fed by means of a diode $D_{11}$ and a resistor $R_2$ to a smoothing capacitor $C_1$. A zener diode $D_5$ is connected across the capacitor $C_1$ for limiting and stabilising the d.c. voltage which is in turn applied to the heating element $HT_1$ by means of the $SCR_1$.

Two fuses $F_1$ and $F_2$ are connected respectively at the anode and cathode of the rectifier $SCR_1$ for protection. A neon indicator lamp $N_1$ is connected in series with a resistor $R_1$ across the heating element $HT_1$ for indicating when power is being supplied to the heating element $HT_1$, i.e. when $SCR_1$ is conducting.

The supply means 13 further comprises a NAND gate $A_2$, third timing means 17 and manually operable switch means 18 for controlling the operation thereof. The NAND gate $A_2$ is connected at its output $P_{10}$ to circuit nodes a and c for controlling the charging and discharging of the capacitor $C_4$, and to an input $P_1$ of the NAND gate $A_4$ for controlling the provision of the firing signal by the NAND gate $A_4$.

The third timing means 17 includes a capacitor $C_5$ and a charging path f-j for the capacitor $C_5$, the charging path f-j consisting of a diode $D_7$ and a resistor $R_8$. Through the path f-j, the capacitor $C_5$ can be charged whenever the output $P_4$ of the NAND gate $A_3$ is at logic high. The capacitor $C_5$ is connected to inputs $P_8$ and $P_9$ of the NAND gate $A_2$.

A pushbutton switch $SW_2$ is connected across the capacitor $C_5$ for quick discharging of the capacitor $C_5$ as hereinafter described.

The manually operable switch means 18 includes a capacitor $C_2$, a pushbutton switch $SW_1$ connected across the capacitor $C_2$, a resistor $R_7$ connecting the capacitor $C_2$ to voltage source $V_{DD}$, a logic NAND gate $A_1$ connected at its inputs $P_{12}$ and $P_{13}$ to the capacitor $C_2$, and a diode $D_8$ connecting an output $P_{11}$ of the NAND gate $A_1$ to the capacitor $C_5$.

FIG. 2 shows an electrical hair curler 20 having a handle 21 in which the power control circuit 10 is housed. Otherwise the curler 20 is of conventional construction and comprises a rod-shaped body 22 in which the heating element $HT_1$ of the circuit 10 is located, and a plate 23 hinged to the body 22, the plate 23 being co-operable with the body 22 to grip hair. The two switches $SW_1$ and $SW_2$ and the indicator lamp $N_1$ are located on the handle 21, and the input 11 of the circuit 10 is connected to a power plug 24 by means of wire leads 25.

In use, the power plug 24 is connected to the power source $V_{ac}$, and immediately the inputs $P_{12}$ and $P_{13}$ of the NAND gate $A_1$ are effectively earthed by the capacitor $C_2$, which initially is fully discharged. The output $P_{11}$ of the NAND gate $A_1$ is therefore initially at logic high, and this initiates quick charging up of the capacitor $C_5$, causing the output $P_{10}$ of the NAND gate $A_2$ to go logic low almost instantaneously. This causes the NAND gate $A_4$ to provide a logic high output, and which in turn turns on the transistor $Q_1$ to inhibit the conduction of the $SCR_1$. As a result, the heating element $HT_1$ is not energised.

When the power source $V_{ac}$ is connected, the capacitor $C_2$ starts to be charged through resistor $R_7$. Resistor $R_7$ and capacitor $C_2$ are arranged so that approximately 1 second later capacitor $C_2$ will be fully charged after connection to $V_{ac}$, causing the output $P_{11}$ of the NAND gate $A_1$ to go logic low. Under this condition, the manually operable switch means 18 will have no further effect on the capacitor $C_5$ until it is manually activated.

To energise the heating element $HT_1$, the switch $SW_2$ is momentarily closed to discharge quickly the capacitor $C_5$, whereupon the output $P_{10}$ of the NAND gate $A_2$ goes logic high. The capacitor $C_4$ starts to be charged via the charging path a-b from substantially ground level. As the input $P_5$ of the NAND gate $A_3$ is effectively earthed, by the as yet fully discharged capacitor $C_4$, the second timing means 15 will be controlled by the first timing means 14 to continue to provide a logic high output at the output $P_4$ of the NAND gate $A_3$. At this time, the inputs $P_1$ and $P_2$ of the NAND gate $A_4$ are both at logic high, and the NAND gate $A_4$ provides a logic low output. This causes the transistor $Q_1$ to turn off, and which in turn causes the $SCR_1$ to conduct to apply continuously the rectified d.c. voltage to the heating element $HT_1$.

This operating condition continues until the capacitor $C_4$ is sufficiently charged to provide a logic high capacitor voltage after a certain start-up time interval has elapsed, which is determined by the values of the resistor $R_{12}$ and the capacitor $C_4$. At this time the capacitor $C_4$ raises the input $P_5$ of the NAND gate $A_3$ to logic high level.

When the output $P_4$ of the NAND gate $A_3$ is at logic high, the capacitor $C_3$ will be charged via the paths e-f and g-h until it is sufficiently charged to raise the logic input $P_6$ applied to the NAND gate $A_3$ to logic high. At this time, the output $P_4$ of the NAND gate $A_3$ goes logic low. The capacitor $C_3$ starts to discharge via the discharging path g-h until it discharges sufficiently to lower the logic input $P_6$ applied to the NAND gate $A_3$ to logic low, whereupon the capacitor $C_3$ starts to be charged again as the logic output of the NAND gate $A_3$ is now at logic high. Therefore, the second timing means 15 oscillates to provide an alternating logic signal at the output $P_4$ of the NAND gate $A_3$, and hence at the output $P_3$ of the NAND gate $A_4$.

As described above, the $SCR_1$ will conduct when the output $P_3$ of the NAND gate $A_4$ is at logic low, and will not conduct when the output $P_3$ is at logic high. It follows that the $SCR_1$ will switch between conducting and non-conducting states when the second timer means 15 oscillates.

It is apparent that the $SCR_1$ will conduct continuously during the start-up time interval, and in duty cycles thereafter controlled by second timing means 15. The heating element $HT_1$ will therefore receive full power during the start-up time interval in order to reach its operating temperature as quickly as possible, and will receive reduced power thereafter in order to maintain the operating temperature. In this particular embodiment, the start-up time interval can be set from 30 to 90 seconds by the resistor $R_{12}$, and the full power and the reduced, operating power ratings are arranged respectively to be 80W and 20W, the latter being provided by the second timing means 15 at an output signal of mark-to-space ratio of 1:3.

Immediately after the switch $SW_2$ is momentarily closed, the capacitor $C_5$ is graduately charged via the charging path f-j whenever the output $P_4$ of the NAND gate $A_3$ is at logic high. When the capacitor $C_5$ is eventually charged to provide a logic high capacitor voltage, the output $P_{10}$ of the NAND gate $A_2$ will go logic low, and in turn the output $P_3$ of the NAND gate $A_4$ will go logic high, inhibiting the conduction of the $SCR_1$. Therefore, the heating element $HT_1$ will automatically be switched off after having been energised for a certain period of time. In this particular embodiment, this time period can be set in the range of $60 \pm 15$ minutes by the resistor $R_8$.

The heating element $HT_1$ can also be switched off manually by momentarily closing the switch $SW_1$. When the switch $SW_1$ is closed, the capacitor $C_2$ will be quickly discharged so as to produce a logic high output at the output $P_{11}$ of the NAND gate $A_1$, and which in turn quickly charges up the capacitor $C_5$ to provide a logic high capacitor voltage. Accordingly, the heating element $HT_1$ will be switched off.

After the heating element $HT_1$ has been switched off, either automatically or manually, the capacitor $C_4$ will discharge via the discharging path c-d. It is apparent that the heating element $HT_1$ can be switched again by momentarily closing the switch $SW_2$.

The invention is described by way of example only, and various modifications may be made without departing from the scope of the invention.

What is claimed is:

1. A hair curling appliance including a power control circuit for supplying electrical power from a power source to a heating element of the hair curling appliance, the power control circuit comprising: an input for connection to said power source, an output for connection to said heating element, and supply means between the input and the output for supplying power at a first, relatively higher level for a predetermined start-up time interval, and at a second, relatively lower level after the predetermined start-up time interval has elapsed.

2. A hair curling appliance including a power control circuit as claimed in claim 1, wherein said supply means supplies power continuously to the heating element during the start-up time interval and intermittently thereafter so as to provide a time-averaged lower level of power.

3. A hair curling appliance including a power control circuit as claimed in claim 1, wherein said supply means comprises first timing means for determining the start-up time interval, and second timing means for providing a signal to control the supply of power to said heating element.

4. A hair curling appliance including a power control circuit as claimed in claim 3, wherein the second timing means is inhibited by the first timing means from providing a signal enabling control of the supply of power by the second timing means during the start-up time interval.

5. A hair curling appliance including a power control circuit as claimed in claim 1, wherein said supply means includes timing means through which said supply means is triggerable to cease supplying power to the heating element after a predetermined time interval.

6. A hair curling appliance including a power control circuit as claimed in claim 1, wherein said supply means includes manually operable switch means through which said supply means is triggerable to cease supplying power to the heating element.

7. A hair curling appliance including a power control circuit as claimed in claim 1, further comprising a silicon controlled rectifier which is connected in series with said heating element for switching power supplied thereto.

8. A hair curling appliance including a power control circuit as claimed in claim 1, further comprising rectifier means for converting an a.c. voltage from said power source to a d.c. voltage for said heating element.

9. A hair curling appliance including a power control circuit as claimed in claim 2, wherein said supply means comprises first timing means for determining the start-up time interval, and second timing means for providing a signal to control the supply of power to said heating element.

10. A hair curling appliance including a power control circuit as claimed in claim 9, wherein the second timing means is inhibited by the first timing means from providing a signal enabling control of the supply of power by the second timing means during the start-up time interval.

* * * * *